US005957131A

United States Patent [19]

Hutchinson et al.

[11] Patent Number: 5,957,131

[45] Date of Patent: Sep. 28, 1999

[54] BIOLOGICAL WARFARE MASK

[75] Inventors: Richard W. Hutchinson, Whiteford; Van Roger Jones, Havre de Grace, both of Md.

[73] Assignee: The United States of America as represented by the Secretary of the Army, Washington, D.C.

[21] Appl. No.: 08/903,249

[22] Filed: Jul. 31, 1997

[51] Int. Cl.[6] ..... A62B 18/10

[52] U.S. Cl. ..... 128/206.17; 128/201.25; 128/201.26; 128/205.27; 128/206.11; 128/206.17

[58] Field of Search ..... 128/206.17, 206.11, 128/205.27, 205.25, 203.11, 201.25, 200.29, 207.18, 206.29, 201.18, 206.24, 201.26

[56] References Cited

U.S. PATENT DOCUMENTS

| | | | |
|---|---|---|---|
| 690,663 | 1/1902 | Pratt | 128/201.18 |
| 4,601,468 | 6/1986 | Roy | 128/207.16 |
| 4,648,398 | 3/1987 | Agdanowski et al. | 128/207.18 |
| 4,838,262 | 6/1989 | Katz | 128/207.12 |
| 4,915,105 | 4/1990 | Lee | 128/207.18 |
| 5,005,568 | 4/1991 | Loescher et al. | 128/203.11 |
| 5,186,165 | 2/1993 | Swann | 128/201.25 |
| 5,533,506 | 7/1996 | Wood | 128/207.18 |
| 5,701,885 | 12/1997 | Hall | 128/201.11 |

FOREIGN PATENT DOCUMENTS

| | | | |
|---|---|---|---|
| 156627 | 12/1904 | Germany | 128/206.29 |
| 669841 | 1/1939 | Germany | 128/201.18 |

*Primary Examiner*—John G. Weiss
*Assistant Examiner*—V. Srivastava
*Attorney, Agent, or Firm*—Edward L. Stolarun; Ulysses John Biffoni

[57] ABSTRACT

A respiratory filtration mask that offers protection from hazardous particulate aerosols, vapors, and the like and which is particularly useful for providing respiratory protection from biological warfare agents. The mask provides a military level of protection against biological agents in a half mask configuration, thereby avoiding the disadvantages of a full face mask such as restricted vision, heat buildup, weight, and feeling of enclosure. The mask has a housing enclosing a filter compartment and a gas transfer compartment and an air inlet which allows unfiltered air into the filter compartment. There is a filter medium in the filter compartment which removes contaminants from the unfiltered air and provides filtered air substantially free of contaminants to the gas transfer compartment. A one way air valve regulates air flow between the filter compartment and the gas transfer compartment. Both a mouthpiece and a nasal insert extend outwardly from the housing and allow for the inhalation of filtered air from the gas transfer compartment and the receipt of exhaled air from the mouth and nose of a user. An air exit valve regulates the removal of exhaled air from the gas transfer compartment.

10 Claims, 1 Drawing Sheet

BIOLOGICAL WARFARE MASK

GOVERNMENT INTEREST

The invention described herein may be manufactured, licensed, and used by or for the U.S. Government.

BACKGROUND OF THE INVENTION

1. Field of the Invention

The present invention pertains to respiratory masks, and more specifically relates to respiratory filtration masks that offer protection from hazardous particulate aerosols, vapors, and the like. Specifically, the invention addresses respiratory protection from biological warfare agents in a half-mask configuration.

2. Description of the Prior Art

Respiratory protection masks have been used by the military and police forces as protection against the inhalation of hazardous particulate matter, such as smoke and toxic gas. In the field of respiratory protection, one of the factors by which the level of protection provided by a mask is measured is its fit. The standard United States military mask achieves a fit providing adequate protection against biological as well as chemical warfare agents. However, these military masks seal around the periphery of the face and are referred to as "full face masks". Although such masks provide a high level of protection, they also burden the user to a significant degree. For example, vision is restricted and the use of sights and lenses is made difficult. In addition, full face masks create a heat and weight burden for the user and a feeling of enclosure.

Commercial versions of respiratory protection masks, used to protect the wearer from paint fumes, particulate, and other vapors, are "half masks" that seal around the wearer's nose and mouth. The fit of half masks is generally regarded as inadequate to meet the military standard for protection against biological agents. Commercial evacuation or escape masks utilize a snorkel type mouthpiece and a nose clamp to provide protection while the wearer leaves an area of hazardous vapors. Despite these developments in respiratory protection masks, there has been no protection made which meets the military standard for protection against biological agents in a half-mask form and provides for respiration through the nose as well as the mouth.

It would be desirable to provide a half-mask that meets the military standard for protection against biological agents without the disadvantages of a full face mask configuration. For that purpose, there is provided a respiratory protection half-mask which comprises a mouthpiece seal, constructed from a flexible plastic insert, in combination with high efficiency nose seals which are constructed from foam rubber and a high efficiency particulate filter medium for filtration of biological agents. It is also possible to add chemical vapor adsorbing medium to this mask to provide limited protection against chemical agents and other hazardous vapors.

SUMMARY OF THE INVENTION

Therefore it is an object of the present invention to provide a respiratory device in the half mask configuration providing a military level of protection against biological agents without the burdens of a full mask configuration. It is a further object to provide a half mask which allows breathing through both the nose and mouth.

The invention provides a respiratory mask comprising:

(a) a housing enclosing a filter compartment and a gas transfer compartment;

(b) at least one air inlet for allowing unfiltered air into the filter compartment;

(c) a filter medium positioned in the filter compartment, capable of removing contaminants from the unfiltered air and providing filtered air substantially free of contaminants to the gas transfer compartment;

(d) means for regulating a flow of the filtered air from the filter compartment to the gas transfer compartment comprising at least one air inlet valve positioned between the filter compartment and the gas transfer compartment;

(e) a mouthpiece in airflow communication with the gas transfer compartment which extends outwardly from the housing and allows for the inhalation of filtered air from the gas transfer compartment and the receipt of exhaled air from the mouth of a user;

(f) at least one nasal insert in airflow communication with the gas transfer compartment which extends outwardly from the housing and allows for the inhalation of filtered air from the gas transfer compartment and the receipt of exhaled air from the nose of a user; and (g) means for regulating the removal of exhaled air from the gas transfer compartment comprising at least one air exit valve.

The invention also provides a method for providing filtered air to a user which comprises:

(A) providing a respiratory mask comprising:

(a) a housing enclosing a filter compartment and a gas transfer compartment;

(b) at least one air inlet for allowing unfiltered air into the filter compartment;

(c) a filter medium positioned in the filter compartment, capable of removing contaminants from the unfiltered air and providing filtered air substantially free of contaminants to the gas transfer compartment;

(d) means for regulating a flow of the filtered air from the filter compartment to the gas transfer compartment comprising at least one air inlet valve positioned between the filter compartment and the gas transfer compartment;

(e) a mouthpiece in airflow communication with the gas transfer compartment which extends outwardly from the housing and allows for the inhalation of filtered air from the gas transfer compartment and the receipt of exhaled air from the mouth of a user;

(f) at least one nasal insert in airflow communication with the gas transfer compartment which extends outwardly from the housing and allows for the inhalation of filtered air from the gas transfer compartment and the receipt of exhaled air from the nose of a user; and (g) means for regulating the removal of exhaled air from the gas transfer compartment comprising at least one air exit valve; and (B) causing the inhalation of filtered air through at least one of the mouthpiece and the nasal insert.

DETAILED DESCRIPTION OF THE PREFERRED EMBODIMENT

Figure 1:
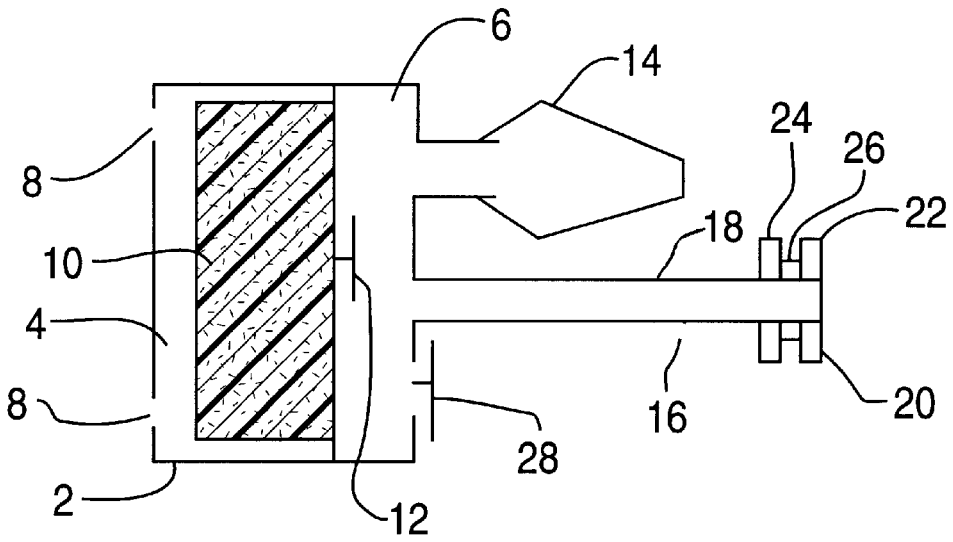
FIG. 1 shows a side schematic view of a biological warfare mask according to the present invention.
Figure 2:
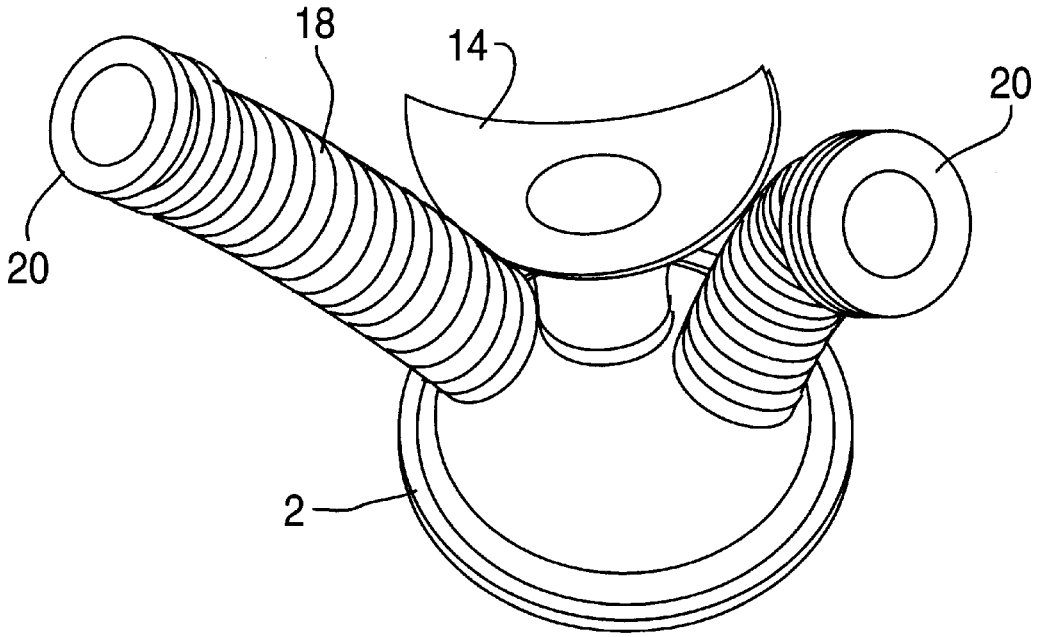
FIG. 2 shows a perspective view of a biological warfare mask according to the present invention.

Referring to FIGS. 1 and 2, a biological warfare respiratory mask according to the present invention is shown to comprise a housing 2 enclosing a filter compartment 4 and a gas transfer compartment 6. Preferably the housing is composed of a suitable plastic. The housing has at least one and preferably two air inlets 8 for allowing unfiltered air into the filter compartment. Supported in the filter compartment 4 is a suitable filter medium 10 which is capable of removing contaminants from the unfiltered air entering air inlets 8 and providing filtered air substantially free of contaminants to the gas transfer compartment 6. Such a filter medium is typically a high efficiency particulate air (HEPA) filter for removing particulate and biological agents and may include a charcoal bed for providing chemical vapor and gas protection.

Flow of filtered air from the filter compartment 4 to the gas transfer compartment 6 is regulated by at least one air valve 12 positioned between the filter compartment and the gas transfer compartment. Extending outwardly from housing 2 from the gas transfer compartment 6 is a mouthpiece 14 in airflow communication with the gas transfer compartment. The mouthpiece 14 has a flexible snorkel configuration which allows for the alternate inhalation of filtered air from the gas transfer compartment and the receipt of exhaled air from the mouth of a user. Also extending outwardly from housing 2 and the gas transfer compartment 6 is at least one and preferably two one nasal inserts 16 in airflow communication with the gas transfer compartment 6 which also allow for the inhalation of filtered air from the gas transfer compartment and the receipt of exhaled air from the nose of a user. The nasal inserts 16 generally comprise a flexible rubber hose member 18 having a nasal seal 20 at one end of the hose. The nasal seal preferably comprises a first annulus 22 and a second annulus 24 attached to the first annulus by an intermediate spacer 26, said spacer having a diameter less than that of the first annulus and the second annulus. Such nasal seals are preferably made of silicon sponge HT-870 foam available from Bisco Products. The seals are preferably attached to flexible hose 18 by silicon rubber adhesive sealant TRV 108 available from the General Electric Company. The nasal seal is adapted for insertion into the nostrils of the user. Typically, the first annulus 22 is inserted into the nostril, the edge of the nostril is positioned against the spacer and the second annulus is positioned as a stop against the front edge of the nostril. The nasal seal provides a tight seal inside the nose. In one embodiment of the invention the nasal seal 16 comprises a two hoses and two nasal seals, one of which is inserted into each nostril of the user. It is within the contemplation of the present invention that a single hose is attachable to a unitary nasal seal wherein the nasal seal attaches to both nostrils. Exhaust air from both the mouthpiece 14 and the nasal insert 16 is exhaled into the gas transfer compartment 6. The mask further has at least one air exit valve 28 which regulates the removal of exhaled air from the gas transfer compartment to the outside surroundings. It can bee seen from the drawing that valve 28 closes during an inhale and opens during an exhale by the user. Air valve 12 is open during an inhale and closed during an exhale by a user. Preferably the air valves 12 and 28 are thin film rubber diaphragms as are well known in the art. Mouthpiece 14, hose 18 and nasal seal 20 are preferably composed of flexible rubber or a rubber-like material. In addition, mouthpiece 14 may also comprise a sponge to facilitate control of saliva. In operation, when the user inhales, contaminated air flows from the air inlet 8, into the filter compartment 4. The filter medium 10 substantially removes contaminants and filtered air moves through open air valve 12 into the mouth and nose of the user through mouthpiece 14 and nasal inserts 16 while air exit valve 28 is closed. Air exhaled onto the gas transfer compartment 6 through mouthpiece 14 and nasal inserts 16 exits the now opened air exit valve 28 while air valve 12 is closed. Therefore the present invention provides a hair mask configuration which allows breathing through the nose and mouth and provides a military level of protection against biological agents without the burdens associated with full mask protection.

While the invention has been described in connection with the preferred embodiment, it will be understood it is not intended to limit the invention to that embodiment. On the contrary, it is intended to cover all alternatives, modifications and equivalents as may be included within the spirit and scope of the invention defined in the appended claims.

What is claimed is:

1. A respiratory mask comprising:

(a) a housing enclosing a filter compartment and a gas transfer compartment;

(b) at least one air inlet for allowing unfiltered air into the filter compartment;

(c) a filter medium positioned in the filter compartment, capable of removing contaminauts from the unfiltered air and providing filtered air substantially free of contaminants to the gas transfer compartment;

(d) means for regulating a flow of the unfiltered air from the filter compartment to the gas transfer compartment comprising at least one air inlet valve positioned between the filter compartment and the gas transfer compartment;

(e) a mouthpiece in airflow communication with the gas transfer compartment which extends outwardly from the housing and allows for the inhalation of filtered air from the gas transfer compartment and the receipt of exhaled air from the mouth of a user;

(f) at least one nasal insert in airflow communication with the gas transfer compartment which extends outwardly from the housing and allows for the inhalation of filtered air from the gas transfer compartment and the receipt of exhaled air from the nose of a user, which includes a flexible hose attached on one end to the gas transfer compartment and a nasal seal attached on another end of te hose, wherein the nasal seal comprises a first, flexible, disk-shaped annulus and a second, flexible, disk-shard annulus attached to the first annulus by an intermediate spacer having a diameter less than the diameters of the first annulus and the second annulus; and (g) means for regulating the removal of exhaled air from the gas transfer compartment comprising at least one air exit valve.

2. The respiratory mask of claim 1, wherein said housing is comprised of plastic.

3. The respiratory mask of claim 1, wherein said air inlet and exit valves comprise one way rubber diaphragms.

4. The respiratory mask of claim 1, wherein said mouthpiece is comprised of a flexible rubber.

5. The respiratory mask of claim 1, wherein said mouthpiece comprises a sponge material.

6. The respiratory mask of claim 1, wherein the nasal seal comprises a flexible, foam rubber material.

7. The respiratory mask of claim 1, wherein said housing is comprised of plastic; wherein said air inlet and exit valves comprise one way rubber diaphragms; wherein said mouthpiece is comprised of a flexible rubber; wherein said nasal insert comprises a pair of flexible rubber hoses attached on one end to the gas transfer compartment and having a flexible nasal seal attached on another end of each of the hoses.

8. The respiratory mask of claim 1, wherein said flexible hose is made of rubber.

9. The respiratory mask of claim 1, wherein said at least one nasal insert comprises a pair of identical nasal inserts.

10. The respiratory mask of claim 1, wherein said first disk-shaped annulus and said second disk-shaped annulus have major planar surfaces extending substantially parallel to each other.

* * * * *